United States Patent [19]

Pizur, Sr.

[11] Patent Number: 4,953,854

[45] Date of Patent: Sep. 4, 1990

[54] STRING EXERCISER

[76] Inventor: Stephen J. Pizur, Sr., 905 Oak Ave., Barnesboro, Pa. 15714

[21] Appl. No.: 396,650

[22] Filed: Aug. 22, 1989

[51] Int. Cl.[5] ..... A63B 21/22; A63H 1/32

[52] U.S. Cl. ..... 272/93; 272/128

[58] Field of Search ..... 272/93, 128, 74, 75

[56] References Cited

U.S. PATENT DOCUMENTS

| | | | |
|---|---|---|---|
| 70,610 | 11/1867 | Porter | 272/128 |
| 2,988,846 | 6/1961 | Samuel . | |
| 3,069,162 | 12/1962 | Samuel . | |
| 3,737,162 | 6/1973 | Wood . | |

*Primary Examiner*—Stephen R. Crow

*Attorney, Agent, or Firm*—Fleit, Jacobson, Cohn, Price, Holman & Stern

[57] ABSTRACT

An exercise apparatus is provided for exercising various portions of the body and includes a pair of elongated, flexible and axially spaced multi-strand tension members between whose adjacent ends a center spinner body is mounted, the remote ends of the tension member having hand grips supported therefrom. The spinner body and adjacent ends of the tension members may spin, cyclically, in opposite directions relative to the remote ends of the tension members from which the handles are supported and timed application and release of forces upon the handles to bias the handles away from each is effective to maintain the spinner body in cyclically varying, opposite direction spinning motion.

4 Claims, 1 Drawing Sheet

STRING EXERCISER

BACKGROUND OF THE INVENTION

1. Field of the Invention

This invention relates to a pair of end-to-end aligned and axially spaced and elongated multi-strand tension member sections including adjacent ends anchored to remote sides of a spinner body disposed therebetween and remote ends anchored relative to handle structures. A user may grip the handles in his hands and alternately apply and release forces thereto biasing the handles away from each other in order to cause the spinner body to spin, alternately, in opposite directions.

2. Description of Related Art

Various different forms of exercise devices and toys including some of the general structural and operational features of the instant invention heretofore have been designed such as those disclosed in U.S. Pat. Nos. 70,610, 1,686,890, 2,938,846, 3,069,162, 3,737,162. However, these previously known exercisers and toys do not include the overall combination of structural and operational features incorporated in the instant invention which simplifies the construction and manufacture of the exerciser and further simplifies maintenance of the exerciser.

SUMMARY OF THE INVENTION

The string exerciser of the instant invention incorporates a pair of axially aligned and spaced, elongated and multi-strand tension members as well as a spinner body mounted between the adjacent ends of the tension members and handles supported from the remote ends of the tension members. The adjacent ends of the tension members are anchored to remote sides of the spinner body against twisting relative thereto and the remote ends of the tension members are similarly anchored to the handles, thereby enabling the spinner body and the adjacent ends of the tension members to alternately spin in opposite directions relative to the remote ends of the tension member and the handles.

The handles may be gripped by the hands of a user and have tension member tensioning forces alternately applied thereto and released.

The main object of this invention is to provide an exerciser which may used by children, teenagers, and adults (including elderly adults) for carrying out various different types of exercises.

Another object of this invention is to provide an apparatus in accordance with the preceding object and which also may be used as a means to enable small children to "use up" access energy.

Another very important object of this invention is to provide an exercise apparatus or toy of the string and spinner type which may be manufactured in various different sizes for use in effecting numerous different body exercising movements.

A final object of this invention to be specifically enumerated herein is to provide an exercise apparatus in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
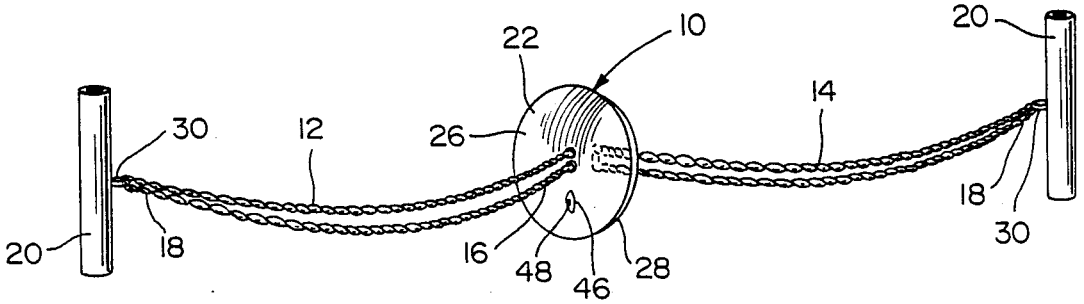
FIG. 1 is a perspective view of the string exerciser of the instant invention with the axially spaced multi-strand tension member end sections in a non-tensioned and non-twisted configuration.

Referring now more specifically to the drawings the numeral 10 generally designates the string exerciser of the instant invention. The exerciser 10 comprises a flexible, elongated tension member structure and incorporates a pair of axially spaced, braided, multi-strand Nylon tension member end sections 12 and 14 including pairs of adjacent and remote ends 16 and 18. In addition, the exerciser 10 includes a pair of handles 20 anchored relative to the remote ends 18 and a central spinner body 22 to which the adjacent ends 16 of the tension member end sections 12 and 14 are anchored.

The spinner body 22 incorporates a pair of generally cupped shaped half body sections 24 and 26 having their open sides joined together along a circumferential zone 28 of the body 22. However, the sections 24 and 26 could be integrally formed, if desired.

The spinner body sections 24 and 26 define remote sides of the spinner body 22 facing toward the handles 20. The handles 20 each comprise cylindrical handle members from whose longitudinal mid portions radial outwardly projecting anchor eyes 30 are supported. The eyes 30 each are disposed in a plane normal to the longitudinal center line of the corresponding handle and each eye 30 is supported from a threaded shank 32 extending through a radial bore 34 formed in the corresponding handle 20, the shanks 32 having retaining nuts 36 threadingly engaged therewith within the interiors of the handles 20. Otherwise, the eyes 30 and shanks 32 could be molded integral with the handles 20.

Each of the tension member end sections 12 and 14 comprises a braided, Nylon tension member end section whose longitudinal mid- portion 38 is passed through the corresponding anchor eye 30 and whose opposite ends 39 are passed through apertures 40 formed in the corresponding spinner body remote side, the ends of each tension member end section 12 and 14 being secured together as at 42 within the corresponding spinner body section. The ends of each tension member end section 12 and 14 may be secured together in various different ways. For example, the ends may be knotted and/melted together if the tension member end sections 12 and 14 are constructed of Nylon.

Figure 4:
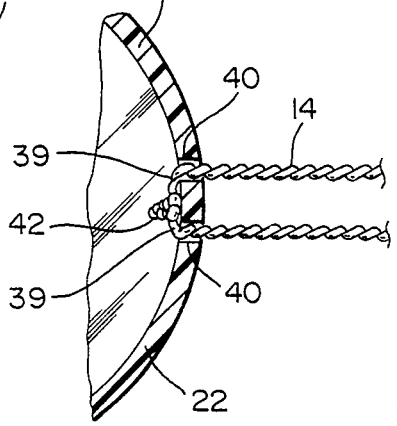
FIG. 4 is an enlarged fragmentary vertical sectional view illustrating the manner in which the ends of one of the multistrand tension end member sections are secured together within the central spinner body of the exerciser.

Also, it is pointed out that at least one of the spinner body sides includes an access opening 46 therein with which a removable closure 48 is operatively associated. The closure 48 may be removably threadedly engaged (or otherwise secured) with those portions of the spinner body section 26 defining the periphery of the access opening 46, or the removable closure 48 may be otherwise anchored from the spinner body side 26. In any event, when the removable closure 48 is removed, those portion of the tension member end sections 12 and 14 such as that indicated as at 42 in FIG. 4 may be pulled through the access opening 46 to the exterior of the spinner body 22 for resecurement or repair. Of course, the access opening 46 and removable closure 48 also are used whenever it is necessary to replace one of the tension member end sections 12 and 14.

Figure 2:
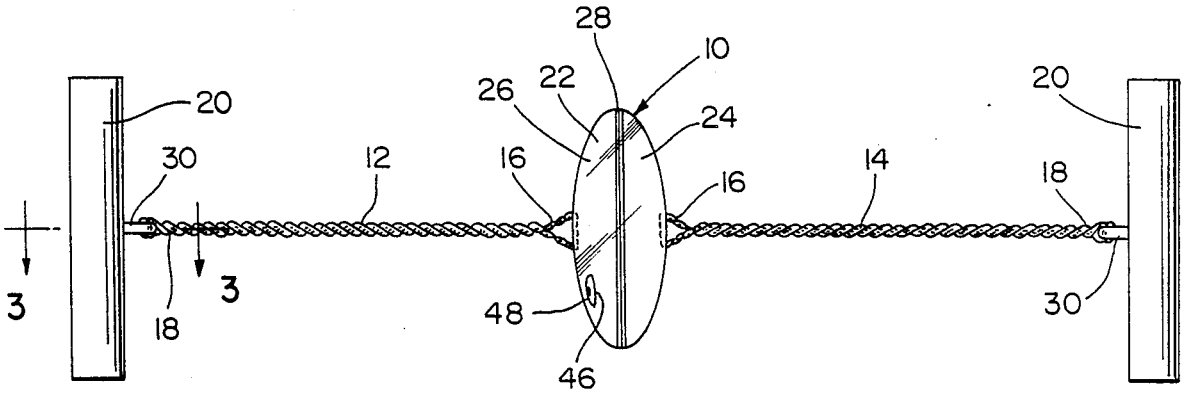
FIG. 2 is an enlarged side elevational view of the exerciser with the central spinner body and the adjacent ends of the multi-strand tension member end sections twisted relative to the remote ends of the tension end member sections to which the handles are mounted.
Figure 3:
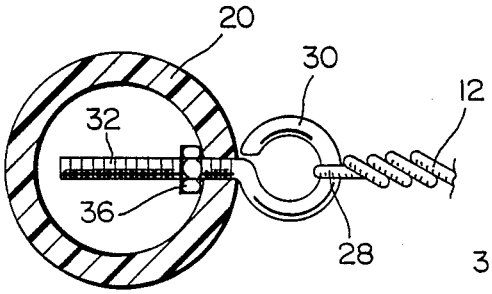
FIG. 3 is an enlarged fragmentary horizontal sectional view taken substantially upon the plane indicated by the section line 3—3 of FIG. 2.

It is believed that operation of the exerciser 10 will be apparent. However, assuming the spinner body 22 and the adjacent ends of the tension member end sections 12 and 14 to be wound relative to the handles 20 as shown in FIG. 2, a force exerted on the handles 20 to bias them apart causes the spinner body 22 to spin in clockwise direction when the exerciser 10 is viewed from the right side of FIG. 2. As the tension member end sections 12 and 14 become unwound in the manner illustrated in FIG. 1, the force on the handles 20 to bias them apart is released and the momentum of the spinning body 22 causes the tension end sections 12 to be wound in the opposite direction.

After spinning of the spinner body 22 in the opposite direction is terminated, a force is again applied to the handles 20 to bias them apart whereby the tension end sections 12 and 14 will unwind and spin the spinner body 22 in a counter clockwise direction when the exercise 10 is viewed from the right side of FIG. 2.

The spinner body 22 may be constructed of any suitable material. Further, the spinner body 22 will be circular about its spinning axis (either cylindrical, spherical or egg shape) and will be of a size and weight, in conjunction with a selected size (diameter) and length of the tension member end section 12 and 14, to provide an exerciser which is comfortable in use to an individual user as well as capable of affording the desired amount of resistance to movement of the handles apart each time the exerciser is forcibly extended. Still further, the exerciser may be marketed in various sizes, colors and shapes.

The foregoing is illustrative only of the principles of the invention. Further, since numerous modifications and changes will readily occur to those skilled in art, it is not desired to limit the invention to the exact construction and operation shown and described, and accordingly, all suitable modifications and equivalents may be resorted to falling within the scope of the invention.

What is claimed as new is as follows:

1. An exerciser comprising a flexible, elongated tension member structure incorporating a pair of axially spaced multi-strand tension member end sections, said end sections including pairs of adjacent and remote ends and handle means supported from said remote ends against twisting relative thereto, said tension member structure including a circular cross section central spinner body mounted between said adjacent ends and against spinning relative thereto about the longitudinal extent of said tension member structure, said adjacent ends being independently anchored relative to central portions of the remote sides of said spinner body facing toward the corresponding end section remote ends, said adjacent ends of said tension member end sections being twistable, in opposite directions, about he longitudinal extent of said tension member structure, relative to said remote ends of said tension member structure end sections and said handle means supported therefrom, said handle means comprising elongated handle members adapted to be gripped in and enclosed within clenched hands of a user, the longitudinal mid-length portions of said handle members including eye portions outstanding therefrom disposed in planes each normal to the longitudinal extent of the corresponding handle member and to which said remote ends are anchored, each of said end sections including a single elongated multi-strand tension member section having a longitudinal mid-portion thereof passed through the corresponding eye portion and its opposite ends anchored to the central portion of the corresponding side of said remote sides of said spinner body, said spinner body being hollow, each of said remote side central portions including a pair of apertures formed therein, said opposite ends of said tension member sections being slidingly received through the corresponding apertures an secured together within the interior of said spinner body, at least one of said remote sides including an access port therein spaced radially outwardly of the corresponding central portion through which each pair of said secured together opposite ends of said tension member sections may be withdrawn.

2. The exerciser of claim 1 wherein said spinner body includes a removable closure for said access port.

3. The exerciser of claim 2 wherein said the spinner body includes cup shaped half sections thereof opening toward each other and secured together, each of said half sections comprising one of said remote sides.

4. The exerciser of claim 1 wherein said elongated handle members comprise tubular members, said eye portions being carried by shank portions passing inwardly through radial bores formed in said tubular members, the inner end portions of said shanks disposed within said tubular members being releasably anchored therein.

* * * * *